US006561070B2

(12) United States Patent
Weber

(10) Patent No.: US 6,561,070 B2
(45) Date of Patent: May 13, 2003

(54) BULLET, BULLET JACKET AND METHODS OF MAKING

(75) Inventor: Dennis H. Weber, Johnson City, TN (US)

(73) Assignee: Alltrista Zinc Products, L.P., Greeneville, TN (US)

( * ) Notice: Subject to any disclaimer, the term of this patent is extended or adjusted under 35 U.S.C. 154(b) by 0 days.

(21) Appl. No.: 10/172,348

(22) Filed: Jun. 14, 2002

(65) Prior Publication Data

US 2002/0152917 A1 Oct. 24, 2002

Related U.S. Application Data

(62) Division of application No. 09/838,097, filed on Apr. 19, 2001.

(51) Int. Cl.[7] ..... F42B 33/00
(52) U.S. Cl. ..... 86/55; 102/516; 102/517
(58) Field of Search ..... 102/501, 514–518; 86/55

(56) References Cited

U.S. PATENT DOCUMENTS

| | | | | |
|---|---|---|---|---|
| 338,849 | A | 3/1886 | Lorenz | |
| 2,309,360 | A | 1/1943 | Southwall | |
| 5,133,259 | A | 7/1992 | Schluckebier | 102/364 |
| 5,394,597 | A | 3/1995 | White | 29/1.23 |
| 5,535,495 | A | 7/1996 | Gutowski | 29/1.22 |
| 5,544,398 | A | 8/1996 | Corzine et al. | 29/1.23 |
| 5,679,920 | A | 10/1997 | Hallis et al. | 102/506 |
| 5,686,693 | A | 11/1997 | Jakobsson | 102/501 |
| 5,852,858 | A | 12/1998 | Hallis et al. | 29/1.22 |
| 5,894,645 | A | 4/1999 | Hallis et al. | 29/1.23 |
| 5,917,143 | A | 6/1999 | Stone | |

FOREIGN PATENT DOCUMENTS

| | | | | |
|---|---|---|---|---|
| DE | 100 45 009 | * | 5/2001 | 102/516 |

* cited by examiner

*Primary Examiner*—Harold J. Tudor
(74) *Attorney, Agent, or Firm*—Ice Miller; Doreen J. Gridley; James D. Wood

(57) ABSTRACT

A bullet, bullet jacket, and method of making the bullet and bullet jacket. The bullet jacket comprises a predominantly copper outer shell and a predominantly zinc lining. The bullet comprises the bullet jacket and a bullet core. The bullet jacket is made by forming a predominantly copper sheet and a predominantly zinc sheet. The two sheets are then adhered to one another by cladding or roll bonding, and shaped such that they can fully encase a bullet core. The bullet is then made by using conventional means to seat and enclose the bullet core within the bullet jacket of the present invention.

6 Claims, 1 Drawing Sheet

BULLET, BULLET JACKET AND METHODS OF MAKING

RELATED PATENT APPLICATION

This patent application is a divisional application of Ser. No. 09/838,097, entitled BULLET, BULLET JACKET AND METHODS OF MAKING, filed on Apr. 19, 2001, and assigned to the same assignee as the present invention.

FIELD OF THE INVENTION

The present invention relates generally to small firearm munitions ("bullets"), and more particularly, to a casing ("jacket") that surrounds a bullet, and a method for making the same.

BACKGROUND OF THE INVENTION

Bullets with a copper jacket and lead core ("standard bullets") are a nearly universal standard in both civilian and military applications. For example, it has been estimated that one manufacturer of small arms ammunition may distribute as many as 5 million standard bullets annually for civilian use. Additionally, the United States military has used standard bullets for decades.

Unfortunately, the use of standard bullets give rise to significant environmental problems. Standard bullets are, in fact, responsible for two major types of environmental hazards. Because 90–95% of the total weight of standard bullets is lead, these bullets have the potential to introduce large quantities of lead toxin into our environment. First, lead vapors and lead dust caused by the use of standard lead bullets in indoor shooting ranges are a significant hazard to employees and users of such ranges. Lead dust and vapors are released from bullets striking target back-stops. The small particles of lead released with each impact eventually permeate the air of these confined areas and may eventually cause serious health difficulties, while the presence of a jacket over a lead core bullet helps to reduce the hazards related to lead dust, any new bullet designs should consider this environmental hazard in the design.

In situations where a large number of standard bullets are fired outdoors, the lead presents a second environmental hazard. Bullets are often left in large quantities on the grounds of practice ranges and on battle fields. Despite the copper jacket surrounding the lead core of standard bullets, these bullets corrode. The lead from standard bullets leaches into the soil, eventually contaminating the soil, rain water run-off and ground water. The cost of hazardous waste clean-up of the lead is often significant—the cost of such a clean-up is, therefore, prohibitive for operators of outdoor shooting ranges. Consequently, the owners of such ranges do not voluntarily engage in a clean-up operation. Thus, lead contamination of the environment by standard bullets left on such ranges merely continues to grow.

In view of the environmental hazards resulting from firing and discarding standard bullets, it is desirable to develop a bullet which eliminates or reduces these hazards. One solution to the environmental hazards is to design bullets that do not contain a lead core. However, the non-lead core bullets present other problems. Such bullets often have a smaller mass than standard bullets. This difference in mass may result in a bullet of less stopping power. In other words, a bullet designed without a lead core may fail in its essential purpose. Furthermore, the small mass of non-lead bullets often leads to significant ricochet problems. A bullet having a weight of approximately 50% of a standard bullet may strike a target and ricochet as far back as to the shooter. Such ricochets present a great danger to target shooters, especially those who shoot in an indoor range. New bullet designs have been developed to address these problems. However, manufacturing new bullet designs requires significant expenditures for the design and construction of new manufacturing tools to accommodate the new bullet designs. Therefore, it is desired to create a bullet that has dimensions and capabilities very similar to those of standard bullets.

The manufacture and use of tungsten bullets is illustrative of additional problems presented by removing lead from bullet designs. Tungsten bullets do not create dusts or vapors when fired, and are inert when stored on the ground. However, tungsten is a very expensive material. The manufacture of tungsten bullets may cost as much as 16 times more than the cost of manufacture of standard bullets having a traditional lead core and copper jacket. Additionally, there is little information regarding the effect of tungsten in a wound. It is known, however, that tungsten powder produces tissue necrosis and that conventional x-ray equipment cannot locate tungsten within a human body. Therefore, a wound created by a tungsten bullet is difficult to treat. Thus, it is desired to produce a bullet, which does not present such problems related to diagnosis and treatment.

U.S. Pat. No. 6,095,052, issued Aug. 1, 2000 also results an alternative to lead core bullets. However, the bullet of this patent also fails to be a complete solution. The invention of this patent involves the attachment of zinc foil to a lead sheet. This sheet and foil are rolled and pressure formed into a bullet having generally helical layers of lead sheet and zinc foil. This method provides a zinc layer over the lead core of a bullet and may be effective in preventing a lead contained in a standard bullet from leaching into soil or ground water. However, the process for making such a bullet is difficult and expensive. Given the high volume of bullets produced by even a single manufacturer, adding complexity to the manufacturing process is likely to have a significant impact on the cost of producing bullets and, by necessary implication, on the cost of purchasing bullets. Therefore, it is desired to provide a bullet which is environmentally friendly but which is reasonable in cost of materials and manufacture.

SUMMARY OF THE INVENTION

The advantages of the present invention are achieved by providing an enviromnentally safe bullet that maintains the performance characteristics of standard bullets. The bullet jacket of the present invention comprises a predominantly copper outer layer and a predominantly zinc lining that is adjacent to the lead core of a bullet. The bullet jacket is formed by roll bonding or cladding a predominantly zinc layer to a predominantly copper layer and shaping, by conventional means, the bi-metallic combination into a bullet jacket. In one embodiment, the predominantly zinc layer of the bullet jacket should not exceed about 30% by weight of the weight bullet jacket, and the predominantly copper layer should not be less than about 70% by weight of the weight bullet jacket. Significant deviation from these guidelines may adversely affect the performance of a bullet employing the bullet jacket.

The bullet of the present invention comprises a bullet jacket formed as described above, and further comprises a substantially lead bullet core. Conventional means for seating and encasing lead bullet core within copper jackets are used to seat the bullet cores of the present invention within the bullet jacket of the present invention. A bullet thus made has several advantages over standard bullets and over bullets containing no lead at all.

As previously discussed, the lead from standard bullets left outside after being fired reacts with the environment causing significant contamination to soil and water. However, when bullets of the present invention are similarly discarded, the zinc lining of the present bullet jacket acts like a battery anode and prevents the lead core from reacting with the environment, thereby preventing environmental contamination of soil and water. As previously discussed, the presence of a jacket over the lead core, also helps to reduce the levels of lead dust occurring upon impact.

The fact that a bullet according to the present invention is environmentally safe while continuing to use a lead core provides several advantages over other bullets. First, because the bullet contains a lead core, it maintains the mass and shape of a standard bullet. Consequently, the performance characteristics of the presently designed bullet, in terms of stopping power and flight, do not differ significantly from standard bullets. Bullets having the present bullet jacket therefore do not require any significant design changes or the collateral expenses associated with new designs that leadless bullets often require. Further, because the lead cores of the present invention are of the type normally used in standard bullets, there is no requirement to design and manufacture unique bullet cores. Therefore, the additional expenses in design and manufacture that would be necessitated by unique bullet cores are avoided by the present invention.

DETAILED DESCRIPTION OF INVENTION

Figure 1:
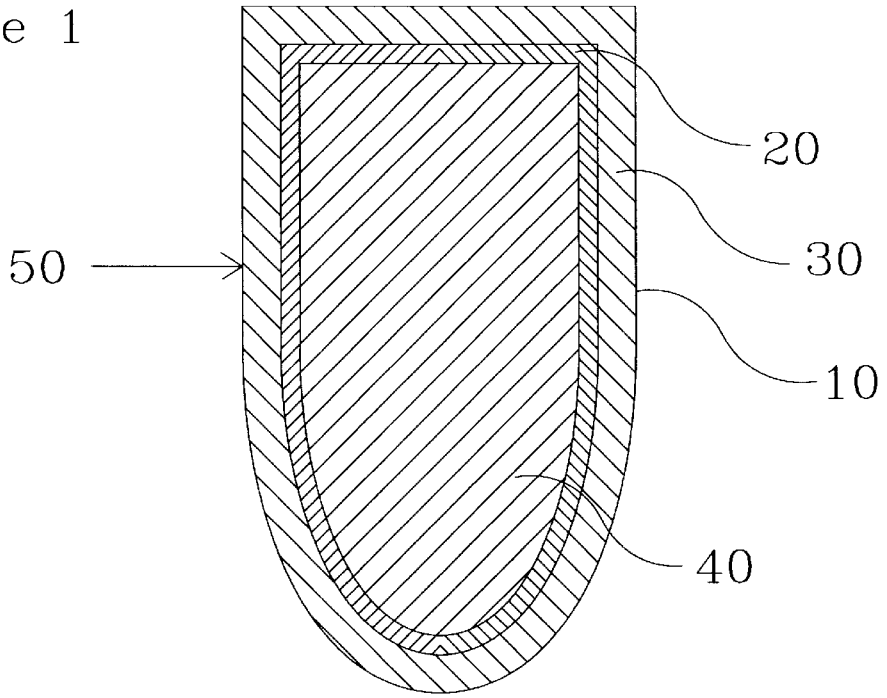
FIG. 1 shows a cross-sectional view of one embodiment of the bullet of the present invention.

Referring now to FIG. 1, there is shown a cross-sectional view of one embodiment of the bullet according to the present invention. In this embodiment, the bullet 50 comprises bullet jacket 10 and bullet core 40. Bullet jacket 10 is comprised of a predominantly zinc layer 20 and a predominantly copper layer 30 adhered to zinc layer 20. Layers 20 and 30 of the bullet jacket 10 are formed into a shape appropriate for the receipt of bullet core 40, such that when bullet core 40 is placed therein predominantly zinc layer 20 is adjacent to the bullet core 40. The size of bullet jacket 10 is chosen to be large enough to fully encase bullet core 40, regardless of the size of the bullet core 40.

In this embodiment, bullet core 40 preferably consists essentially of lead. However, those skilled in the art will recognize that the bullet core 40 may include a blend of metals, which can include various amount of lead. Such a blend will allow for the manufacture of bullets of varying grain weights for use with a range of weapons. Bullet core 40 further comprises substantially conical shape and can be any conventional lead bullet core shape. It will be appreciated that by accommodating a variety of lead bullet cores, bullet jacket 10 of the present invention can be easily used with standard mass produced lead bullet cores. Thus, implementing the present invention in the manufacture of bullet jackets does not require the significant and expensive changes to current manufacturing processes used to produce bullets. Instead, one may merely replace the standard copper bullet jackets with bullet jackets made according to the present invention.

One skilled in the art will also recognize that bullet jacket 10 of the present invention easily accommodates bullet core 40 which has been manufactured by generally understood means and which conforms to the dimensions, mass and material composition of a conventional bullet core.

As stated previously, bullet jacket 10 of the present invention is comprised a predominantly zinc layer 20 and a predominantly copper layer 30. To fall within the scope of the present invention, the zinc layer 20 may be comprised of other alloys, such as aluminum, but the zinc in zinc layer 20 should comprise at least about 97% by weight of the total weight of zinc layer 20. Similarly, copper layer 30 may be comprised of other alloys, such as tin, but that copper in copper layer 30 should comprise at least about 85% by weight of the total weight of copper layer 30.

In testing bullets which employ bullet jacket 10, it has been observed that predominantly zinc layer 20 should generally not comprise more than about 30% by weight of the total weight of bullet jacket 10, and predominantly copper layer 30 should generally comprise less than about 70% by weight of the total weight of bullet jacket 10. Significant deviation from these guidelines could adversely affect the performance of a bullet manufactured according to the present invention.

It will be appreciated by one skilled in the art that predominantly zinc layer 20 and predominantly copper layer 30 may be formed into sheets by conventional manufacturing means such as casting and rolling. Generally, predominantly zinc layer 20 and predominantly copper layer 30 must be directly adhered to one another such that the two layers will not separate during the manufacture of bullet jacket 10, during the manufacture or use of a bullet made according to the present invention, or during firing or projection of such a bullet.

In one embodiment of bullet jacket 10, predominantly zinc layer 20 is roll-bonded to predominantly copper layer 30. In yet another embodiment of bullet jacket 10, the layer of predominantly zinc 20 is cladded to the layer of predominantly copper 30.

It will be appreciated by one of skill in the art that any method of directly adhering predominantly zinc layer 20 to predominantly copper layer 30 can be used as long as the method employed results in prevention of separation of layers 20 and 30 from each other during the manufacturing process or loading or firing of a bullet manufactured according to the present invention.

As shown in FIG. 1, bullet jacket 10 is formed into a shape which encases bullet core 40, such that the predominantly zinc layer 20 is adjacent to bullet core 40. In other words, bullet jacket 10 is shaped for receipt of bullet core 40, with predominantly zinc layer 20 surrounding and engaging the shape of bullet core 40.

In bullet 50 according to the present invention, bullet core 40 preferably consists essentially of lead or lead alloys. It will be appreciated that the bullet jacket of the present invention provides a protective covering of zinc to prevent the introduction of lead into the environment from discarded lead bullets. Bullet jacket 10 encases entire bullet core 40. Specifically, predominantly zinc layer 20 rests between, and in direct contact with bullet core 40 and predominantly copper layer 30. When bullet 50 is exposed to the environment, whether before, during or after firing, it is surrounded by bullet jacket 10 of the present invention in the same way that a standard copper jacket surrounds a standard bullet. However, bullet jacket 10 includes predominantly zinc layer 20 directly adjacent to the bullet core 40 which acts as a sacrificial anode when bullet 50 is, for example, left outdoors after having been fired. Thus, bullet 50 of the present invention prevents the leaching of lead into the environment by bullets left on the ground outside after firing as described in more detail below.

Predominantly zinc layer 20 in bullet 50 acts like the anode in a battery by taking on additional electrons. Conversely, predominantly copper layer 30 acts like the cathode in a battery by giving up electrons. When bullet 50 is left outside, the environment chemically reacts with copper layer 30 and zinc layer 20 rather than bullet core 40. In this manner, bullet jacket 10 prevents lead from bullet core 40 from leaking into and contaminating outdoor soil and water.

Another advantage realized by bullet 50 is that it may accommodate standard mass produced lead bullet cores. By doing so, bullet 50 is able to maintain the mass and dimensions of standard bullets of various calibers. Consequently, bullet 50 is able to maintain the expected performance characteristics of standard bullets. Maintaining these performance characteristics eliminates the need for new bullet exterior designs or new gun designs to recreate the performance characteristics of a standard bullet. For example, 90% to 95% of the mass of a standard bullet typically comes from lead. A bullet's "stopping power" is directly related to its mass. A bullet made according to the present design is able to maintain the use of a dense lead core and thus a relatively high mass and good stopping power. A bullet design which sought to protect the environment by removing lead from the bullets would require extensive efforts to design bullets with the same stopping power and other performance characteristics of standard bullets. In addition, a bullet so designed requires new weapons designs to accommodate such a bullet. To the contrary, bullet 50 of the present design addresses environmental issues without sacrificing bullet performance or necessitating the expenses associated with redesigning bullets or guns, or the tools that produce both products.

The present invention also includes a method of making the bullet jacket 10. The first step in the method of making bullet jacket 10 is to form the layer of predominantly zinc 20. As stated previously, one skilled in the art will understand that this step can be accomplished by any generally understood means such as rolling. The second step in making the bullet jacket 10 is to use similar methods to form the layer of predominantly copper 30.

The next step in the method of making bullet jacket 10 is to adhere the layer of predominantly zinc 20 directly to the layer of predominantly copper 30. As previously discussed, this adherence step is accomplished by roll-bonding, cladding, or other methods well known in the art. It will be appreciated by one skilled in the art that the one advantage of the use of either roll-bonding or cladding is that layers 20 and 30 will not separate during the manufacture or use of a bullet employing bullet jacket 10. Another advantage of these adherence methods is that roll-bonding and cladding are well known methods of bonding one metal directly to the other and can be accomplished without great expense. However, other means of adhering sheets of copper and zinc to each other, such as adhesive laminating, are contemplated to be within the scope of the invention.

Adhering predominantly zinc layer 20 to predominantly copper layer 30 results in formation of a bimetallic strip or sheet. In order to avoid adversely affecting the performance of a bullet comprising the bullet jacket 10 of the present invention, it is recommended no more than about 30% by weight of this strip or sheet should be composed of predominantly zinc layer 20 and no less than about 70% by weight of this strip or sheet should be composed of predominantly copper layer 30.

The method of making the bullet jacket 10 next requires shaping the combined layers 20 and 30 into a form capable of receiving the bullet core 40, wherein the layer of predominantly zinc 20 is adjacent to bullet core 40. This step may be accomplished by any conventional means such as stamping and drawing, whereby adhered layers 20 and 30 are made to encase the entire bullet core 40 and the layer of predominantly zinc will be adjacent to the bullet core 40.

The present invention also includes a method of making bullet 50. The first step is to determine the caliber of bullet one intends to make. The dimensions of bullet jacket 10 will depend on this decision. The appropriate bullet core 40 is chosen to conform with the caliber of bullet desired. The next step in the method of making bullet 50 is to form predominantly zinc layer 20 and predominantly copper layer 30, as previously described herein. The next step in making bullet 50 is to adhere predominantly zinc layer 20 directly to predominantly copper layer 30 as previously described herein.

The method of making bullet 50 next requires shaping the combined layers 20 and 30 into a form capable of receiving the bullet core 40, wherein the layer of predominantly zinc 20 will be adjacent to the bullet core 40 as previously described herein.

The final step in making bullet 50 is to introduce bullet core 40 into the bullet jacket 10. One method of accomplishing this is to place bullet core 40 within bullet jacket 10 such that one end of bullet core 40 rests on the interior base of bullet jacket 10, and the sides of bullet core 40 rest against the interior sides of bullet jacket 10. The opposite end of bullet core 40 is recessed below the open end of bullet jacket 10. Bullet core 40 is pressed into bullet jacket 10 and bullet jacket 10 is made to enclose bullet core 40 using a commonly available "bullet press." One skilled in the art will understand that that this step can be accomplished by any means currently employed to enclose bullet cores with copper bullet jackets, and that the description above is used merely to illustrate one such means.

It will be appreciated by those of skill in the art that the individual steps required to make the bullet jacket and bullet of the present invention are conventional. Thus, a manufacturer does not need to learn new processes for such individual steps, nor is a significant investment in new metal working equipment required. Therefore, the methods of the present invention are relatively inexpensive and uncomplicated when compared to methods required to make prior art alternatives to standard bullets. Further, the materials required are readily available—a big plus in keeping material costs reasonable.

Figure 2:
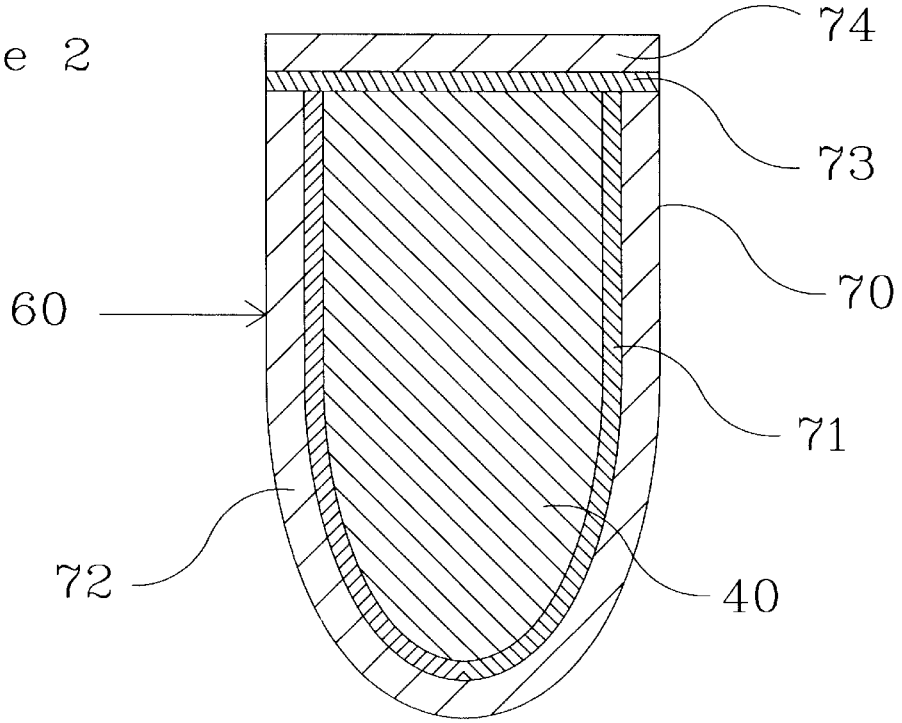
FIG. 2 shows a cross-sectional view of a second embodiment of the bullet of the present invention.

Referring now to FIG. 2, there is shown a second embodiment of the bullet according to the present invention. In this embodiment, bullet 60 comprises bullet core 40 and bullet jacket 70. As in the embodiment FIG. 1, bullet core 40 of FIG. 2 is comprised primarily of lead or lead alloy and is conical in shape, and bullet jacket 70 is comprised of copper (or copper alloy) and zinc (or zinc alloy). Bullet jacket 70 is comprised of first predominantly zinc layer 71 and first predominantly copper layer 72 surrounding the majority of bullet core 40, and of second predominantly zinc layer 73 and second predominantly copper layer 74 over the end cap portion of bullet core 40. Bullet jacket 70 is made according to the same method described above in association with bullet 50 of FIG. 1. To make bullet 60, bullet jacket 70 is formed into two pieces (perhaps from the same adhered sheets of copper and zinc) and one piece is formed for receipt of bullet core 40 and another piece formed to connect the end cap. Those two pieces are then adhered to each other by means well known in the art, such as pressing.

Having described the present inventions in terms of their various embodiments and as illustrated by the accompanying figures, it will be recognized by those skilled in the art that certain changes can be made to the specific embodiments discussed herein without changing the manner in which the components or steps of the present invention function or achieve their intended result. All such changes are intended to fall within the spirit and scope of the following claims.

I claim:

1. A method of making a bullet jacket, comprising the steps of:

forming a predominantly zinc layer;

forming a predominantly copper layer;

adhering the predominantly zinc layer to the predominantly copper layer; and shaping the adhered layers into a form capable of receiving a bullet core such that, when a bullet core is placed in the formed shaped, the predominantly zinc layer is adjacent to the bullet core.

2. The method of making the bullet jacket of claim 1, wherein the step of adhering the predominantly zinc layer to the predominantly copper layer comprises roll-bonding the predominantly zinc layer to the predominantly copper layer.

3. The method of making the bullet jacket of claim 1, wherein the step of adhering the predominantly zinc layer to the predominantly copper layer comprises cladding the predominantly zinc layer to the predominantly copper layer.

4. A method of making a bullet, comprising the steps of:

providing a shaped bullet core;

forming a predominantly zinc layer;

forming a predominantly copper layer;

adhering the predominantly zinc layer to the predominantly copper layer;

shaping the adhered layers to receive the bullet core such that the predominantly zinc layer is adjacent to the bullet core;

placing the bullet core within the shaped form;

seating the bullet core within the formed shape; and enclosing the bullet jacket around the bullet core.

5. The method of making the bullet of claim 4, wherein the step of adhering said predominantly zinc layer to said predominantly copper layer comprises roll-bonding the predominantly zinc layer to the predominantly copper layer.

6. The method of making the bullet of claim 4, wherein the step of adhering the predominantly zinc layer to the predominantly copper layer comprises cladding the predominantly zinc layer to the predominantly copper layer.

* * * * *